US011939971B2

(12) United States Patent
Ikedo

(10) Patent No.: US 11,939,971 B2
(45) Date of Patent: Mar. 26, 2024

(54) FOUR-CYLINDER DIAPHRAGM PUMP

(71) Applicant: SIBATA SCIENTIFIC TECHNOLOGY LTD., Saitama (JP)

(72) Inventor: Yuji Ikedo, Saitama (JP)

(73) Assignee: SIBATA SCIENTIFIC TECHNOLOGY LTD. (JP)

( * ) Notice: Subject to any disclaimer, the term of this patent is extended or adjusted under 35 U.S.C. 154(b) by 331 days.

(21) Appl. No.: 17/431,555

(22) PCT Filed: Dec. 26, 2019

(86) PCT No.: PCT/JP2019/051187
§ 371 (c)(1),
(2) Date: Aug. 17, 2021

(87) PCT Pub. No.: WO2020/170605
PCT Pub. Date: Aug. 27, 2020

(65) Prior Publication Data

US 2022/0136495 A1 May 5, 2022

(30) Foreign Application Priority Data

Feb. 19, 2019 (JP) ..... 2019-027607

(51) Int. Cl.
*F04B 43/073* (2006.01)
*F04B 43/00* (2006.01)
(Continued)

(52) U.S. Cl.
CPC ..... *F04B 43/0736* (2013.01); *F04B 45/043* (2013.01); *F04B 43/0045* (2013.01); *F04B 43/025* (2013.01)

(58) Field of Classification Search
CPC ..... F04B 43/0736; F04B 45/043; F04B 43/0045; F04B 43/025; F04B 43/026; F04B 11/005
See application file for complete search history.

(56) References Cited

U.S. PATENT DOCUMENTS 5,380,164 A * 1/1995 Fry ..... F04B 19/06 347/85
2017/0306935 A1* 10/2017 Fujiwara ..... F04B 43/026

FOREIGN PATENT DOCUMENTS

EP 0743452 11/1996
JP 06-028280 4/1994
(Continued)

OTHER PUBLICATIONS

JP2012188983A translation (Year: 2023).*
(Continued)

*Primary Examiner* — Charles G Freay
*Assistant Examiner* — David N Brandt
(74) *Attorney, Agent, or Firm* — Clark Hill PLC; James R. Foley

(57) ABSTRACT

A four-cylinder diaphragm pump includes a pump body having four pump chambers, and a drive mechanism that expands and contracts the four pump chambers with a predetermined phase difference, in which the pump body includes a first diaphragm having two diaphragm portions on a same plane, and a second diaphragm having two diaphragm portions on a same plane disposed to be located to be parallel to or coplanar with the plane of the first diaphragm, each of the diaphragm portions of the first diaphragm and the second diaphragm constitute a portion of a different pump chamber, and the drive mechanism is configured to move the diaphragm portions of the first diaphragm and the second diaphragm forward or backward with respect to the corresponding pump chambers with a predetermined phase difference.

2 Claims, 10 Drawing Sheets

(51) Int. Cl.
*F04B 43/02* (2006.01)
*F04B 45/04* (2006.01)

(56) References Cited

FOREIGN PATENT DOCUMENTS

| | | | | |
|---|---|---|---|---|
| JP | H08-270569 | | | 10/1996 |
| JP | 2004-124894 | | | 4/2004 |
| JP | 2012-188983 | | | 10/2012 |
| JP | 2012188983 | A | * | 10/2012 |
| WO | 2018/037443 | | | 3/2018 |

OTHER PUBLICATIONS

English translation of International Preliminary Report on Patentability that issued in connection with PCT/JP2019/051187.
International Preliminary Report on Patentability that issued in connection with PCT/JP2019/051187.

* cited by examiner

SINGLE PHASE

TWO PHASES

FOUR PHASES

FOUR-CYLINDER DIAPHRAGM PUMP

This application is a National Phase Filing of PCT/JP2019/051187, having an International filing date of Dec. 26, 2019, which claims priority of Japanese Patent Application No. 2019-027607, having a filing date of Feb. 19, 2019. The disclosure of the foregoing are hereby incorporated by reference.

TECHNICAL FIELD

The present invention relates to a four-cylinder diaphragm pump having four pump chambers.

BACKGROUND ART

In the related art, a diaphragm pump configured to allow fluid to flow only in one direction by reciprocations of a diaphragm forming a portion of a pump chamber and interaction between check valves provided on an inflow side and an outflow side of the pump chamber is widely known (Patent Literature 1).

Since the diaphragm pump has a structure in which only one of the reciprocations of the diaphragm is taken out by the check valve, pulsation is included in the flow of the fluid. For this reason, in a single-cylinder diaphragm pump in which a fluid flows by a single pump chamber, such as the diaphragm pump of Patent Literature 1, there is a problem in that a flow rate accuracy decreases due to pulsation of the fluid and an operation sound is large.

In recent years, a multi-cylinder diaphragm pump having a plurality of pump chambers is known as a diaphragm pump capable of reducing influences of such pulsation. For example, Patent Literature 2 discloses a four-cylinder diaphragm pump including an eccentric shaft eccentrically attached to a rotation shaft of a drive motor, four diaphragm portions attached at intervals of 90° along a circumferential direction of the eccentric shaft, and a base (manifold, housing, or the like) that forms a pump chamber between the diaphragm portions and is configured to join and discharge fluids discharged from the pump chambers.

According to the four-cylinder diaphragm pump of Patent Literature 2, it is possible to drive the four diaphragm portions with a phase difference of 90° to shift the phases of the fluids flowing out from the four pump chambers, and it is possible to suppress pulsation of the fluids by joining the fluids with the shifted phases to cancel the pulsation of the fluids.

CITATION LIST

Patent Literature

Patent Literature 1: JP 08-270569 A
Patent Literature 2: European Patent No. 0743452

SUMMARY OF INVENTION

Technical Problem

However, the four-cylinder diaphragm pump of the related art has a problem that the number of components is larger and the size is larger than those of the single-cylinder diaphragm pump and the two-cylinder diaphragm pump. In addition, since the four diaphragm portions are arranged toward the four surfaces around the rotation shaft in the four-cylinder diaphragm pump of the related art, it is necessary to process the base from six surfaces including the four surfaces around the rotation shaft and the upper and lower surfaces, and there is a problem that it is difficult to mass-produce the diaphragm pump using a component production unit using a mold such as plastic or die casting. Furthermore, in the four-cylinder diaphragm pump of the related art, it is necessary to assemble each component from six surfaces, and there is a problem that the number of assembling steps is large and a work load is large.

The present invention has been made in view of the above-described problems of the related art, and an object thereof is to provide a four-cylinder diaphragm pump that can be downsized and can have a simple structure.

Solution to Problem

According to an aspect of the present invention, there is provided a four-cylinder diaphragm pump including: a pump body having four pump chambers; and a drive mechanism that expands and contracts the four pump chambers with a predetermined phase difference, in which the pump body includes a first diaphragm having two diaphragm portions on a same plane, and a second diaphragm having two diaphragm portions on a same plane disposed to be located to be parallel to or coplanar with the plane of the first diaphragm, each of the diaphragm portions of the first diaphragm and the second diaphragm constituting a portion of a different pump chamber, and the drive mechanism moving the diaphragm portions of the first diaphragm and the second diaphragm forward or backward with respect to the corresponding pump chambers with a predetermined phase difference.

In the four-cylinder diaphragm pump according to the present invention, the drive mechanism may include a drive source having a rotation shaft extending parallel to each plane of the first diaphragm and the second diaphragm, a first oscillating body provided corresponding to the first diaphragm, and a second oscillating body provided corresponding to the second diaphragm, each of the two diaphragm portions of the first diaphragm and the second diaphragm may be disposed to be separated from each other in a direction orthogonal to the rotation shaft with the rotation shaft as a boundary, each of the first oscillating body and the second oscillating body may include an eccentric portion attached eccentrically to the rotation shaft, an attachment portion attached to the eccentric portion via a bearing, a first arm portion extending from the attachment portion to one diaphragm portion, and a second arm portion extending from the attachment portion to the other diaphragm portion, and may be configured to oscillate according to rotation of the rotation shaft to move the one diaphragm portion and the other diaphragm portion forward or backward with a predetermined phase difference, and the first oscillating body and the second oscillating body may be attached to the rotation shaft so as to be oscillated each other with a predetermined phase difference.

In the four-cylinder diaphragm pump according to the present invention, a distance between the plane and a center of the bearing in a direction orthogonal to the plane of the first diaphragm may be smaller than an inter-centroid distance between the two diaphragm portions of the first diaphragm, and a distance between the plane and a center of the bearing in a direction orthogonal to the plane of the second diaphragm may be smaller than an inter-centroid distance between the two diaphragm portions of the second diaphragm.

In this case, the distance between the plane and the center of the bearing in the direction orthogonal to the plane of the first diaphragm may be ½ of the inter-centroid distance between the two diaphragm portions of the first diaphragm, and the distance between the plane and the center of the bearing in the direction orthogonal to the plane of the second diaphragm may be ½ of the inter-centroid distance between the two diaphragm portions of the second diaphragm.

In the four-cylinder diaphragm pump according to the present invention, the first diaphragm and the second diaphragm may be disposed to face each other so as to be parallel to each other via the rotation shaft, and the eccentric portion of the first oscillating body and the eccentric portion of the second oscillating body may be eccentric to each other in the same direction.

In the four-cylinder diaphragm pump according to the present invention, the first diaphragm and the second diaphragm may be disposed such that the respective planes are located on the same plane, and the eccentric portion of the first oscillating body and the eccentric portion of the second oscillating body may be eccentric in directions opposite to each other.

Advantageous Effects of Invention

According to the present invention, it is possible to provide a four-cylinder diaphragm pump capable of being downsized and having a simple structure.

BRIEF DESCRIPTION OF DRAWINGS

FIG. 7 is an operation process diagram in which the operations of the respective pump chambers are arranged along a time series, in which

FIG. 9 is a diagram illustrating a schematic configuration of a four-cylinder diaphragm pump according to a second embodiment, in which

DESCRIPTION OF EMBODIMENTS

Hereinafter, preferred embodiments for carrying out the present invention will be described with reference to the drawings. Note that the following embodiments do not limit the invention according to each claim, and all combinations of features described in the embodiments are not necessarily essential to the solution of the invention.

First Embodiment

First, a four-cylinder diaphragm pump 1 according to a first embodiment of the present invention will be described. The four-cylinder diaphragm pump 1 according to the first embodiment is schematically a four-phase four-cylinder diaphragm pump in which two sets of pump chambers 12*a*, 12*b*, 12*c*, and 12*d* are disposed vertically and configured to suppress pulsation of the fluid discharged from an exhaust port 22 by causing the fluid to flow out from a total of four pump chambers 12*a* to 12*d* with phases shifted and joining these fluids.

Figure 1:
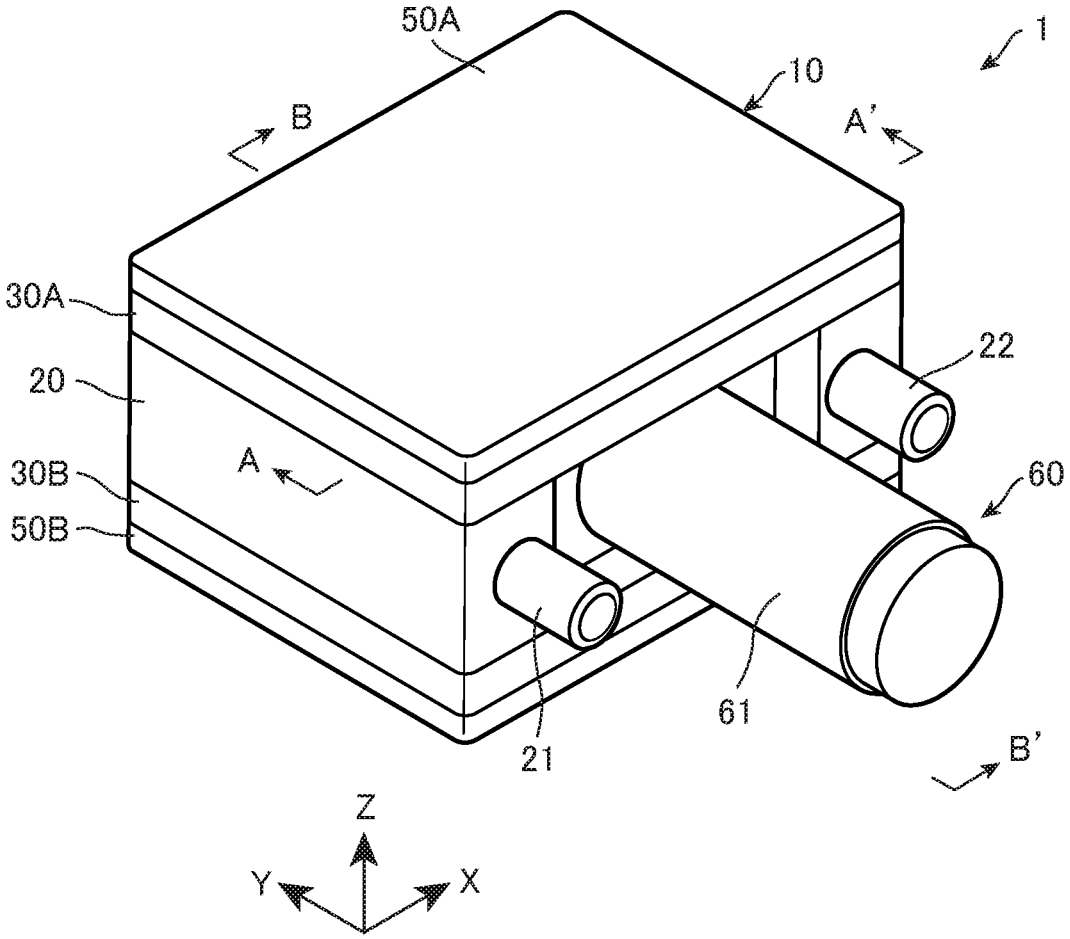
FIG. 1 is a perspective view illustrating a four-cylinder diaphragm pump according to a first embodiment.
Figure 2:
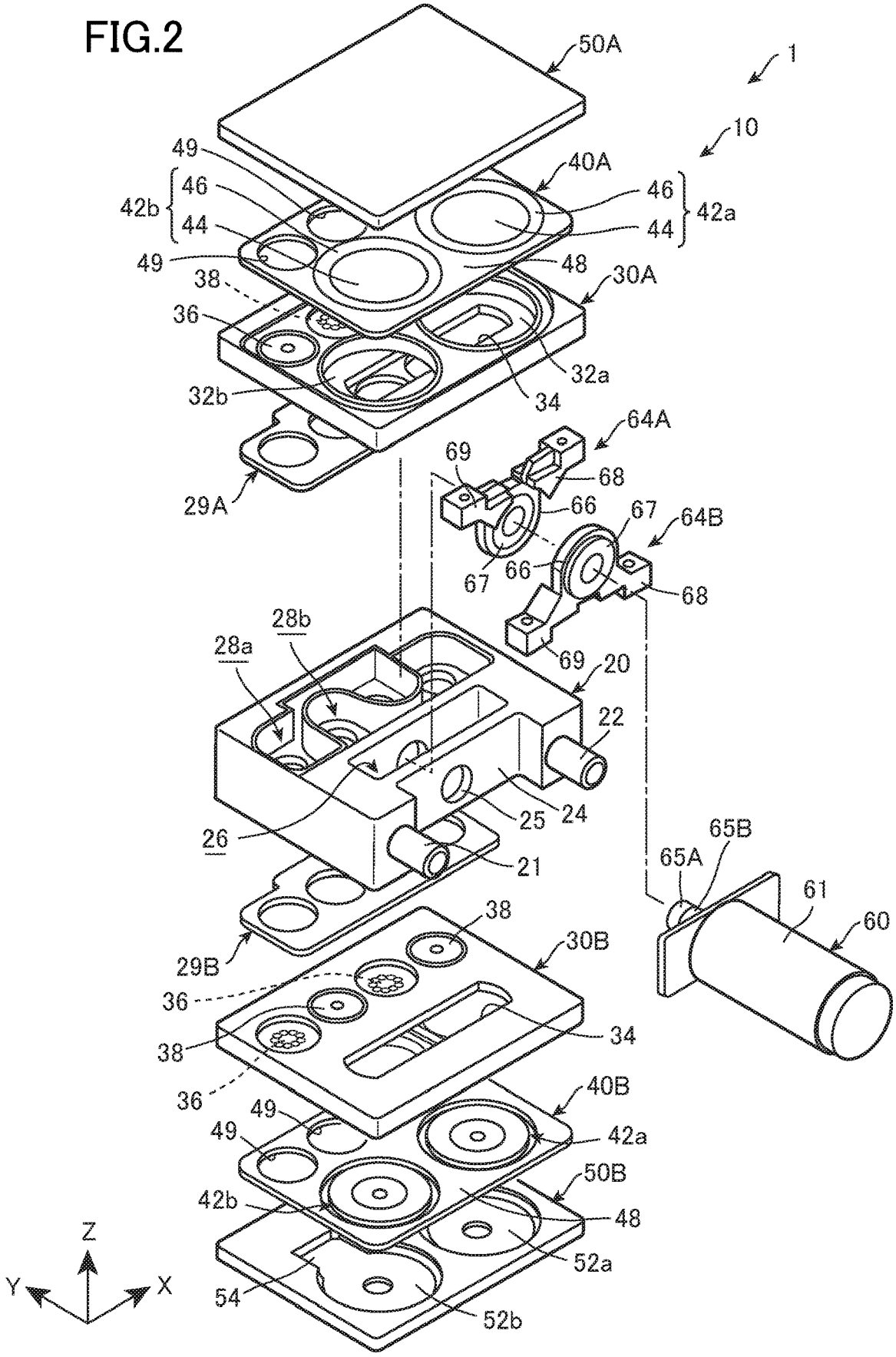
FIG. 2 is an exploded view of the four-cylinder diaphragm pump according to the first embodiment.

Specifically, as illustrated in FIGS. 1 and 2, the four-cylinder diaphragm pump 1 according to the first embodiment includes a pump body 10 having a total of four pump chambers 12*a* to 12*d*, two sets each in the vertical direction, and a drive mechanism 60 that expands and contracts the four pump chambers 12*a* to 12*d* with a predetermined phase difference.

As illustrated in FIGS. 1 and 2, the pump body 10 includes a base member 20 having an intake port 21 and an exhaust port 22, and a pair of upper and lower packing members 29A and 29B, a pair of upper and lower valve seat members (first valve seat member 30A and second valve seat member 30B), a pair of upper and lower diaphragms (first diaphragm 40A and second diaphragm 40B), and a pair of upper and lower head members (first head member 50A and second head member 50B), which are stacked on an upper surface side and a lower surface side of the base member 20, respectively.

Figure 3:
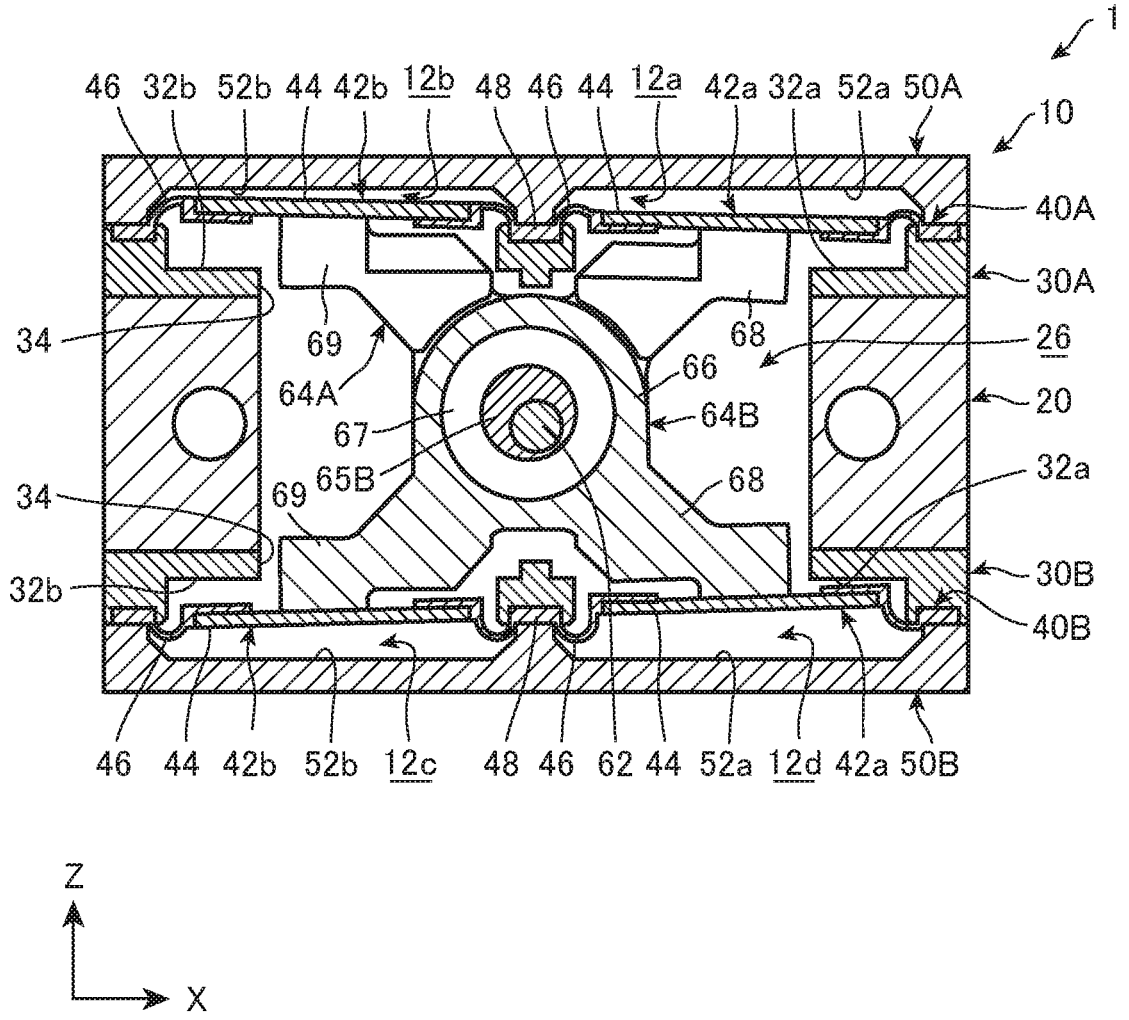
FIG. 3 is a schematic cross-sectional view taken along line A-A' of FIG. 1.
Figure 4:
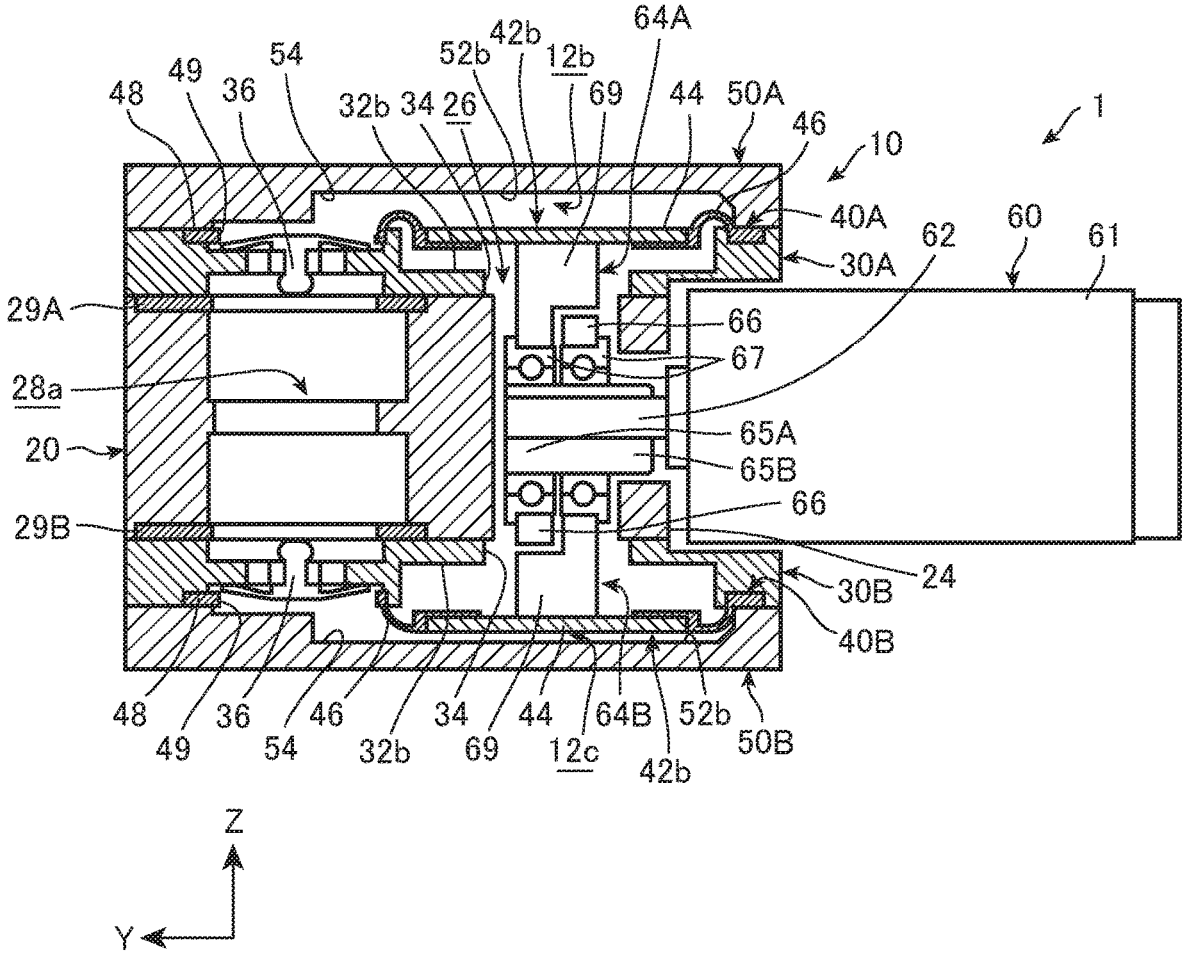
FIG. 4 is a schematic cross-sectional view taken along line B-B' in FIG. 1.

In addition, as illustrated in FIGS. 2 to 4, the drive mechanism 60 includes a drive motor (drive source) 61 having a rotation shaft 62, and a first oscillating body 64A and a second oscillating body 64B that are eccentrically attached to the rotation shaft 62 and configured to repeatedly oscillate with the rotation of the rotation shaft 62.

In the present specification, the "vertical direction" or a "height direction" refers to a stacking direction (direction Z in FIGS. 1 and 2) of the valve seat members 30A and 30B, the diaphragms 40A and 40B, and the head members 50A and 50B with respect to the base member 20, and a "horizontal direction" refers to a direction orthogonal to the vertical direction. Furthermore, in the present specification, a "width direction" refers to a direction orthogonal to the rotation shaft 62 of the drive motor 61 (direction X in FIGS. 1 and 2) in the horizontal direction, and a "depth direction" refers to a direction (direction Y in FIGS. 1 and 2) in which the rotation shaft 62 of the drive motor 61 extends in the horizontal direction.

In the pump body 10, the packing members 29A and 29B, the valve seat members 30A and 30B, the diaphragms 40A and 40B, and the head members 50A and 50B are stacked in the order of the packing members 29A and 29B→the valve seat members 30A and 30B→the diaphragms 40A and 40B→the head members 50A and 50B based on the base member 20, and are integrated with each other by being fastened to each other using fastening means such as screws. In a state where the respective members are integrated as described above, the pump body 10 has a flat rectangular outer shape having a dimension in the width direction>a dimension in the depth direction>a dimension in the height direction as illustrated in FIG. 1. Moreover, the pump body 10 has a vertically symmetrical internal structure with a center of the base member 20 in the height direction as a boundary. Hereinafter, each component of the pump body 10 will be described in detail.

The base member 20 is a flat rectangular member made of synthetic resin or the like, and includes, as illustrated in FIGS. 2 to 4, the intake port 21 and the exhaust port 22 provided on a surface on the front side in the depth direction, an attachment recess 24 which is provided between the intake port 21 and the exhaust port 22 and to which the drive motor 61 is attached, and an accommodation portion 26 in which the first and second oscillating bodies 64A and 64B are accommodated. The attachment recess 24 is a recess formed on the front surface of the base member 20 in the depth direction, and the accommodation portion 26 is a through hole penetrating from an upper surface to a lower surface of the base member 20. A through hole 25 through which the rotation shaft 62 of the drive motor 61 to which eccentric portions 65A and 65B described below are fixed is inserted is formed between the attachment recess 24 and the accommodation portion 26.

As illustrated in FIG. 2, in the base member 20, an intake-side joining space 28*a* that causes the fluid flowing in from the intake port 21 to flow toward each of the pump chambers 12*a* to 12*d* and an exhaust-side joining space 28*b* that causes the fluids discharged from each of the pump chambers 12*a* to 12*d* to be joined and be discharged from the exhaust port 22 are formed to be vertically symmetrical and in a staggered manner on a back side of the accommodation portion 26 in the depth direction. The intake-side joining space 28*a* is configured to communicate the intake port 21 with intake ports of the pump chambers 12*a* to 12*d*, and the exhaust-side joining space 28*b* is configured to communicate exhaust ports of the pump chambers 12*a* to 12*d* with the exhaust port 22.

The first valve seat member 30A and the second valve seat member 30B are rectangular plate-shaped members made of synthetic resin or the like, and are formed by disposing an intake valve 36 and an exhaust valve 38 described below in plane symmetry with each other in the same member that can be molded by a common mold. The first valve seat member 30A and the second valve seat member 30B are disposed to face each other so as to be parallel to each other via (with) the rotation shaft 62 of the drive motor 61 (as a boundary). As illustrated in FIGS. 2 to 4, each of the valve seat members 30A and 30B is formed with a pair of recesses 32*a* and 32*b* for providing movable spaces of diaphragm portions 42*a* and 42*b* of the diaphragms 40A and 40B to be described below, and a horizontally long insertion hole 34 formed over the pair of recesses 32*a* and 32*b*, at a position matching the accommodation portion 26 of the base member 20. The recesses 32*a* and 32*b* are recesses having a shape larger than the outer shapes of the diaphragm portions 42*a* and 42*b*, and the insertion hole 34 is a through hole through which arm portions 68 and 69, which will be described below, of the first and second oscillating bodies 64A and 64B of the drive mechanism 60 can be inserted.

Moreover, in the first valve seat member 30A and the second valve seat member 30B, as illustrated in FIGS. 2 to 4, the intake valve 36 and the exhaust valve 38 corresponding to the pump chambers 12*a* to 12*d* are alternately provided at positions matching the intake-side joining space 28*a* and the exhaust-side joining space 28*b* of the base member 20. The intake valve 36 is a check valve capable of allowing the fluid to flow in a direction from the intake-side joining space 28*a* of the base member 20 toward each of the pump chambers 12*a* to 12*d* and capable of preventing the fluid from flowing in the opposite direction, and the exhaust valve 38 is a check valve capable of allowing the fluid to flow in a direction from each of the pump chambers 12*a* to 12*d* toward the exhaust-side joining space 28*b* of the base member 20 and capable of preventing the fluid from flowing in the opposite direction. Circumferences of the intake valve 36 and the exhaust valve 38 are sealed by packing members 29A and 29B disposed between the base member 20 and the valve seat members 30A and 30B. Openings for allowing a fluid to pass are formed in the packing members 29A and 29B at positions matching the two intake valves 36 and the two exhaust valves 38. In the illustrated example, an umbrella-shaped check valve is exemplified as the intake valve 36 and the exhaust valve 38, but the present invention is not limited thereto, and various check valves can be adopted.

The first diaphragm 40A and the second diaphragm 40B are the same thin plate-shaped seal member made of a flexible material such as rubber, and are disposed to face each other so as to be plane-symmetric. As illustrated in FIGS. 2 to 4, each of the diaphragms 40A and 40B includes a pair of diaphragm portions 42*a* and 42*b* at positions matching the pair of recesses 32*a* and 32*b* of the valve seat members 30A and 30B. Specifically, the first diaphragm 40A includes two diaphragm portions 42*a* and 42*b* on the same plane, the second diaphragm 40B includes two diaphragm portions 42*a* and 42*b* on the same plane which is arranged to be parallel to the plane of the first diaphragm 40A. The two diaphragm portions 42*a* and 42*b* in each of the first diaphragm 40A and the second diaphragm 40B are disposed to be separated from each other in a direction (width direction X) orthogonal to the rotation shaft 62 of the drive motor 61 with the rotation shaft 62 as a boundary.

As illustrated in FIGS. 2 to 4, the diaphragm portions 42*a* and 42*b* are configured to be able to form pump chambers 12*a* to 12*d* between pump chamber forming recesses 52*a* and 52*b* described below of the head members 50A and 50B and the diaphragm portions 42 and 42*b*. In this case, one diaphragm portion 42*a* and the other diaphragm portion 42*b* of the first diaphragm 40A and one diaphragm portion 42*a* and the other diaphragm portion 42*b* of the second diaphragm 40B constitute parts of different pump chambers 12*a* to 12*d*, respectively.

Each of the diaphragm portions 42*a* and 42*b* has a circular operation surface 44 which is a portion that moves forward or backward (moves up and down) with respect to the pump chambers 12*a* to 12*d*, and a flexible edge 46 which is provided so as to surround a periphery of the operation surface 44 and has flexibility to allow the forward or backward movement of the operation surface 44 by being elastically deformed. The operation surface 44 is connected to the oscillating bodies 64A and 64B of the drive mechanism 60, and is configured to move forward or backward with respect to the pump chambers 12*a* to 12*d* in accordance with oscillation of the oscillating bodies 64A and 64B.

As illustrated in FIGS. 2 to 4, each of the diaphragms 40A and 40B is formed with openings 49 for allowing a fluid to pass through at positions matching the two intake valves 36 and the two exhaust valves 38 provided in each of the valve seat members 30A and 30B. In each of the diaphragms 40A and 40B, a region other than the pair of diaphragm portions 42*a* and 42*b* and the four openings 49 constitutes a horizontal fixing portion 48 interposed between the valve seat members 30A and 30B and the head members 50A and 50B.

As illustrated in FIGS. 3 and 4, the fixing portion 48 of the first diaphragm 40A and the fixing portion 48 of the second diaphragm 40B are parallel to each other in a state where the diaphragms 40A and 40B are interposed between the valve seat members 30A and 30B and the head members 50A and 50B, respectively, and this parallel state is maintained even during the operation of the diaphragm portions 42*a* and 42*b*. Each fixing portion 48 is configured to be a sealing surface when being in close contact with the valve seat members 30A and 30B and the head members 50A and 50B.

Figure 5A:
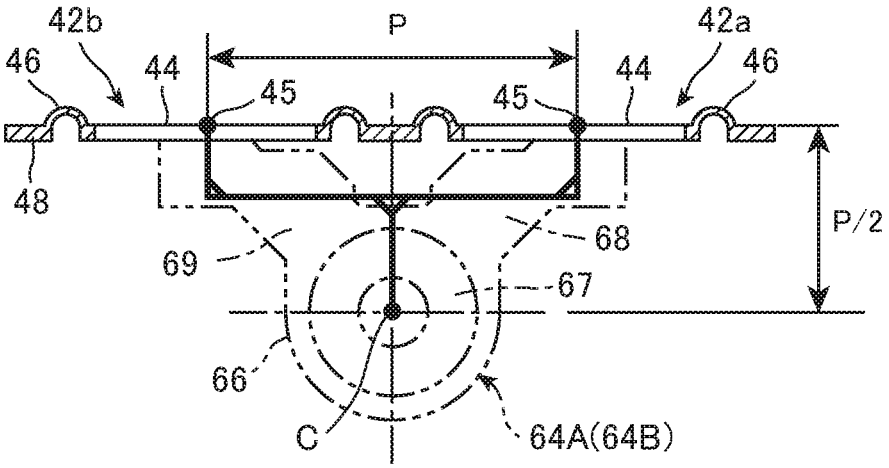
FIG. 5 is a schematic view for explaining dimensions and operation of an oscillating body.
Figure 5B:
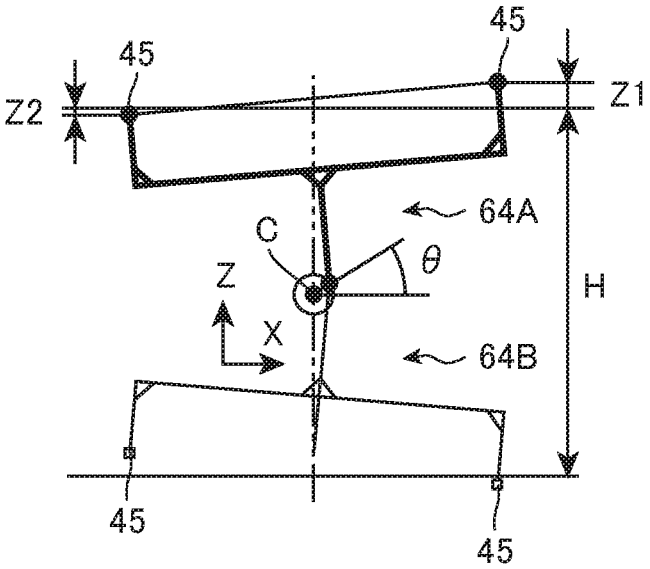

The first diaphragm 40A and the second diaphragm 40B having the above configuration are disposed to face each other so as to be parallel to each other via (with) the rotation shaft 62 of the drive motor 61 (as a boundary). As illustrated in FIGS. 5A and 5B, preferably, an interval H between the fixing portion 48 of the first diaphragm 40A and the fixing portion 48 of the second diaphragm 40B is set to be substantially equal to a distance (inter-centroid distance P) between a centroid 45 of one diaphragm portion 42*a* and a centroid 45 of the other diaphragm portion 42*b* in each of the diaphragms 40A and 40B (to have a relationship of H≈P). In the first embodiment, since the diaphragms 40A and 40B are circular, the inter-centroid distance P is a center-to-center distance between the two diaphragm portions 42*a* and 42*b*.

As illustrated in FIGS. 2 to 4, the first head member 50A and the second head member 50B are the same rectangular plate-like member made of synthetic resin or the like, and are disposed to face each other so as to be parallel to each other via (with) the rotation shaft 62 of the drive motor 61 (as a boundary). In each of the head members 50A and 50B, the pair of pump chamber forming recesses 52*a* and 52*b* is provided at positions matching the pair of diaphragm portions 42*a* and 42*b* of the diaphragms 40A and 40B. Each of the pump chamber forming recesses 52*a* and 52*b* is a recess having substantially the same size and outer shape as each of the diaphragm portions 42*a* and 42*b*, and is configured to be able to form the pump chambers 12*a* to 12*d* with each of the diaphragm portions 42*a* and 42*b*. In the first embodiment, the bottom surfaces of the pump chamber forming recesses 52*a* and 52*b* are parallel surfaces, but the present invention is not limited thereto, and the bottom surfaces may be inclined surfaces in accordance with the inclination of the diaphragm portions 42*a* and 42*b* at a top dead center. With such a configuration, a dead volume can be reduced.

In each of the head members 50A and 50B, as illustrated in FIGS. 2 to 4, a communication groove 54 is formed for each of the pump chamber forming recesses 52*a* and 52*b*. The communication groove 54 allows the fluid to flow into each of the pump chambers 12*a* to 12*d* from the intake-side joining space 28*a* through the opening of the packing member 29A or 29B, the intake valve 36 of the valve seat member 30A or 30B, and the opening 49 of the diaphragm 40A or 40B, and allows the fluid to flow out from each of the pump chambers 12*a* to 12*d* to the exhaust-side joining space 28*b* through the opening 49 of the diaphragm 40A or 40B, the exhaust valve 38 of the valve seat member 30A or 30B, and the opening of the packing member 29A or 29B.

The drive motor 61 of the drive mechanism 60 is attached to the attachment recess 24 of the base member 20 such that the rotation shaft 62 extends in parallel to each plane (fixing portion 48) of the first diaphragm 40A and the second diaphragm 40B via the through hole 25 of the base member 20. Since various known drive motors can be employed as the drive motor 61, a detailed description thereof will be omitted.

The first oscillating body 64A and the second oscillating body 64B are so-called yokes. As illustrated in FIGS. 2 to 4, the first oscillating body 64A is provided corresponding to the first diaphragm 40A, and the second oscillating body 64B is provided corresponding to the second diaphragm 40B. As illustrated in FIGS. 2 to 4, each of the oscillating bodies 64A and 64B includes eccentric portions 65A and 65B attached eccentrically to the rotation shaft 62, an attachment portion 66 attached to the eccentric portions 65A and 65B via a bearing 67, a first arm portion 68 extending from the attachment portion 66 to one diaphragm portion 42*a*, and a second arm portion 69 extending from the attachment portion 66 to the other diaphragm portion 42*b*.

As illustrated in FIGS. 2 to 4, each of the eccentric portions 65A and 65B is a cylindrical eccentric shaft eccentric by a predetermined amount in the radial direction from a central axis of the rotation shaft 62, and is fixed to the rotation shaft 62 of the drive motor 61 with a screw or the like (not illustrated) so as to be relatively non-rotatable and axially immovable. In the first embodiment, the eccentric portion 65A of the first oscillating body 64A and the eccentric portion 65B of the second oscillating body 64B are integrally formed, are eccentric in the same direction, and have the same eccentric amount. The eccentric portions 65A and 65B may be separate and independent members. With such an eccentric structure, the eccentric portions 65A and 65B are configured to convert rotational movement by the drive motor 61 into the oscillation of the oscillating bodies 64A and 64B, and further into the forward or backward movement of the operation surfaces 44 of the diaphragm portions 42*a* and 42*b*.

As illustrated in FIGS. 2 to 4, the attachment portion 66 has a circular opening into which the bearing 67 can be fitted, and is fixed to the eccentric portions 65A and 65B via the bearing 67 so as to be relatively rotatable and immovable in the axial direction. Each of the attachment portions 66 is formed to be thinner than the first arm portion 68 and the second arm portion 69, and is configured such that when the attachment portion 66 of the first oscillating body 64A and the attachment portion 66 of the second oscillating body 64B are combined, the first arm portions 68 and 68 of the first oscillating body 64A and the second oscillating body 64B and the second arm portions 69 and 69 of the first oscillating body 64A and the second oscillating body 64B are aligned along the vertical direction.

As illustrated in FIGS. 2 to 4, the first arm portion 68 is fixed to the centroid (center) 45 of one diaphragm portion 42*a* of each of the diaphragms 40A and 40B by fastening means (not illustrated) such as a screw, and the second arm portion 69 is fixed to the centroid (center) 45 of the other diaphragm portion 42*b* of each of the diaphragms 40A and 40B by fastening means (not illustrated) such as a screw. Note that the fixing positions of the first arm portion 68 and the second arm portion 69 may not be the centroid (center) 45 as long as the fixing positions are within the range of the operation surfaces 44 of the diaphragm portions 42*a* and 42*b*. In addition, as long as the operation surfaces 44 of the diaphragm portions 42*a* and 42*b* and the first arm portion 68 and the second arm portion 69 have a structure in which they cannot move relative to each other in the X direction and the Z direction in the drawing, for example, a rotatable fixing method or a fixing method in which inclination is allowed may be used.

The first oscillating body 64A and the second oscillating body 64B are configured such that a distance between the plane of the first diaphragm 40A and the center C of the bearing 67 in a direction orthogonal to each plane (fixing portion 48) of the first diaphragm 40A and the second diaphragm 40B is equal to a distance between the plane of the second diaphragm 40B and the center C of the bearing 67 in the same direction. As illustrated in FIG. 5A, each of the oscillating bodies 64A and 64B is configured such that the distance between the plane and the center C of the bearing 67 is smaller than the inter-centroid distance P between the two diaphragm portions 42*a* and 42*b*, and is preferably half (P/2) the inter-centroid distance P.

Figure 6:
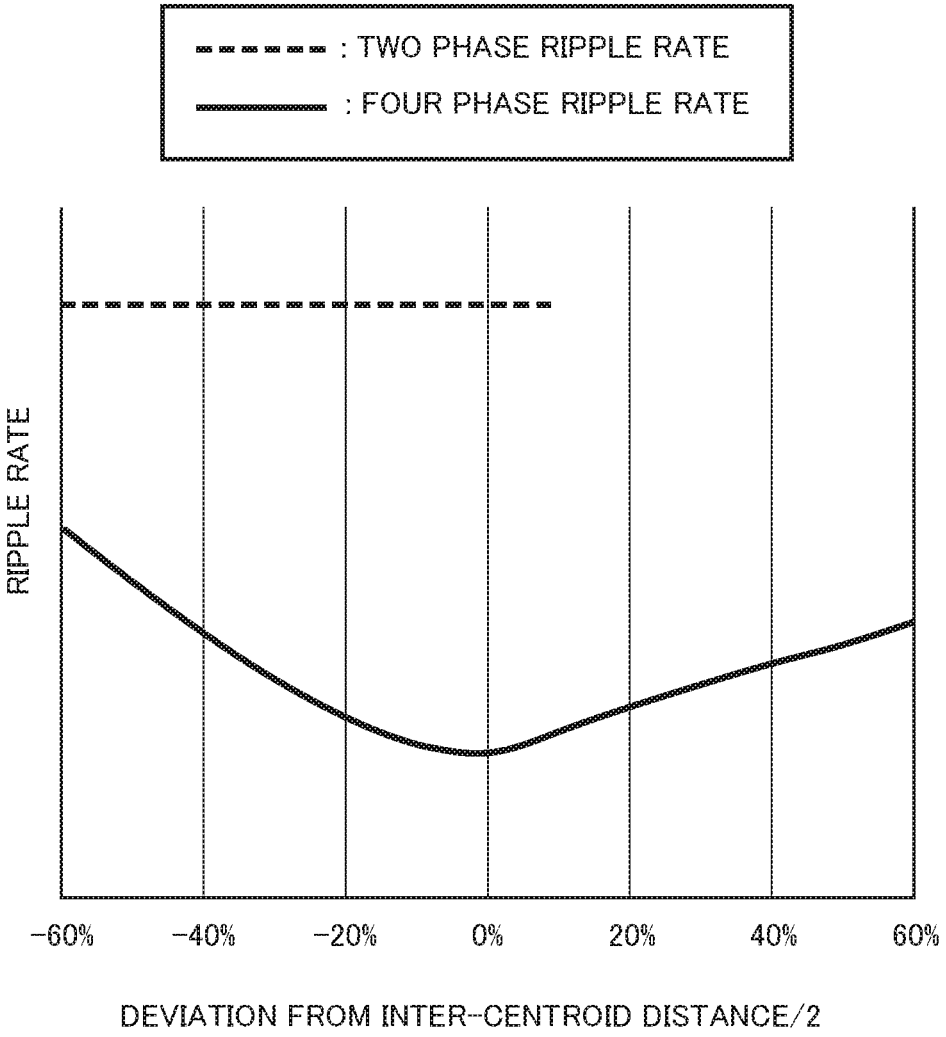
FIG. 6 is a view illustrating a relationship between the dimensions of an oscillating body and a magnitude of pulsating flow (ripple rate).

According to the first oscillating body 64A and the second oscillating body 64B according to the first embodiment, as described above, by setting the distance between the plane and the center C of the bearing 67 to half (P/2) of the inter-centroid distance P, the four pump chambers 12*a* to 12*d* can be accurately expanded and contracted with a phase difference of 90°, and thus, as illustrated in FIG. 6, a ripple rate (pulsating flow) can be minimized. However, as is clear from FIG. 6, even in a case where the distance between the plane and the center C of the bearing 67 is not half (P/2) of the inter-centroid distance P (for example, in a case where the distance deviates by ±60%), it is possible to greatly reduce the pulsating flow as compared with the two-phase pump.

Here, operations of the first oscillating body 64A and the second oscillating body 64B will be described with reference to FIGS. 5A and 5B. In general, since the flexible edges 46 of the diaphragms 40A and 40B are made relatively thin so that the operation surface 44 can move up and down, a rigidity in the Z direction (the vertical movement direction of the operation surface 44) in the drawing due to a bending moment is low. On the other hand, since a rigidity in the X direction (width direction) in the drawing is caused due to a shearing force, the rigidity is maintained relatively high even if the thickness is thin. It is also easy to set a ratio of the rigidity in the Z direction and the rigidity in the X direction to 20 times to 100 times depending on the dimension. Therefore, by forming the shape of the flexible edge 46 into an appropriate shape, at least within a practical range, even when lower end portions (attachment portions 66) of the oscillating bodies 64A and 64B are moved in an XZ plane, only the movement and inclination of the operation surface 44 in the Z direction are allowed, and the operation surface 44 does not move in the X direction.

Moreover, when the lower end portions (attachment portions 66) of the oscillating bodies 64A and 64B are rotationally driven by the eccentric portions 65A and 65B having an eccentric amount e, a displacement of each lower end portion is divided into a Z direction component and an X direction component. The Z-direction component is directly the Z-direction displacement. On the other hand, as described above, the X direction component cannot be translated due to the rigidity in the X direction of the diaphragms 40A and 40B, and is converted into an inclination with a midpoint between the centroid (center) 45 of one operation surface 44 and the centroid (center) 45 of the other operation surface 44 as a fulcrum in the plane of the flexible edge 46 of the diaphragms 40A and 40B, and is converted into displacement in the Z direction as it is in the case of the dimensional relationship by this inclination. As a result, since heights Z1 and Z2 of the center of the diaphragm illustrated in FIG. 5B are the sum of the Z direction component and the X direction component, the following Formulas (1) and (2) are established, and a phase difference of 90° occurs in the forward or backward movement of one diaphragm portion 42*a* and the other diaphragm portion 42*b*.

$$Z1 \approx e \sin\theta + e \cos\theta = \sqrt{2}e \sin(\theta + 45°) \quad (1)$$

$$Z2 \approx e \sin\theta - e \cos\theta = \sqrt{2}e \sin(\theta - 45°) \quad (2)$$

Further, in the first embodiment, in addition to the first oscillating body 64A in which the phase difference of 90° is generated in the forward or backward movement of the one diaphragm portion 42*a* and the other diaphragm portion 42*b*, the second oscillating body 64B obtained by inverting the first oscillating body 64 by 180° is further provided, and thus, the heights of the operation surfaces 44 of the four diaphragm portions 42*a* and 42*b* move up and down with the phase difference of 90°. That is, the four pump chambers 12*a* to 12*d* can be expanded and contracted with high accuracy with a phase difference of 90°.

Next, the operation of the four-cylinder diaphragm pump 1 according to the first embodiment will be described with reference to FIG. 7. In the following description, a pump chamber formed between the pump chamber forming recess 52*a* on a right side of a paper surface of the first head member 50A and the diaphragm portion 42*a* on a right side of a paper surface of the first diaphragm 40A is referred to as a "first pump chamber 12*a*", a pump chamber formed between the pump chamber forming recess 52*b* on a left side of the paper surface of the first head member 50A and the diaphragm portion 42*b* on a left side of the paper surface of the first diaphragm 40A is referred to as a "second pump chamber 12*b*", a pump chamber formed between the pump chamber forming recess 52*b* on a left side of a paper surface of the second head member 50B and the diaphragm portion 42*b* on a left side of a paper surface of the second diaphragm 40B is referred to as a "third pump chamber 12*c*", and a pump chamber formed between the pump chamber forming recess 52*a* on a right side of a paper surface of the second head member 50B and the diaphragm portion 42*a* on a right side of a paper surface of the second diaphragm 40B is referred to as a "fourth pump chamber 12*d*".

The four-cylinder diaphragm pump 1 according to the first embodiment rotates the rotation shaft 62 of the drive motor 61 to rotate the eccentric portions 65A and 65B, and thus, the first oscillating body 64A and the second oscillating body 64B are oscillated at a predetermined phase difference (180° in the first embodiment) while the first arm portion 68 and the second arm portion 69 in each of the oscillating bodies 64A and 64B are oscillated at a predetermined phase difference (90° in the first embodiment). As a result, the four diaphragm portions of the pair of diaphragm portions 42*a* and 42*b* of the first diaphragm 40A and the pair of diaphragm portions 42*a* and 42*b* of the second diaphragm 40B move forward or backward with respect to the corresponding pump chambers 12*a* to 12*d*, respectively, with a predetermined phase difference (90° in the first embodiment), and as illustrated in FIGS. 7A to 7D, the four pump chambers 12*a* to 12*d* are repeatedly expanded and contracted with the phase difference of 90°. An operation of pushing out and an operation of sucking the fluid are alternately and continuously performed by the expansion and contraction of the four pump chambers 12*a* to 12*d* and the interaction (rectification) between the intake valve 36 and the exhaust valve 38.

Figure 7A:
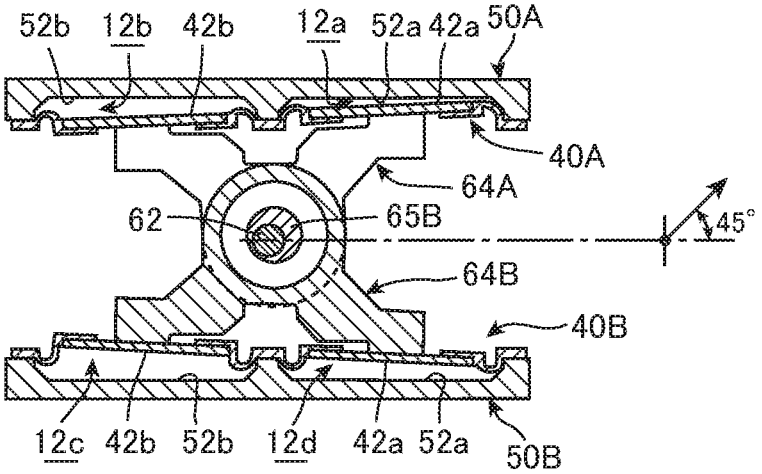
FIG. 7A illustrates a state in which the pump chamber at the upper right in the drawing is contracted.
Figure 7B:
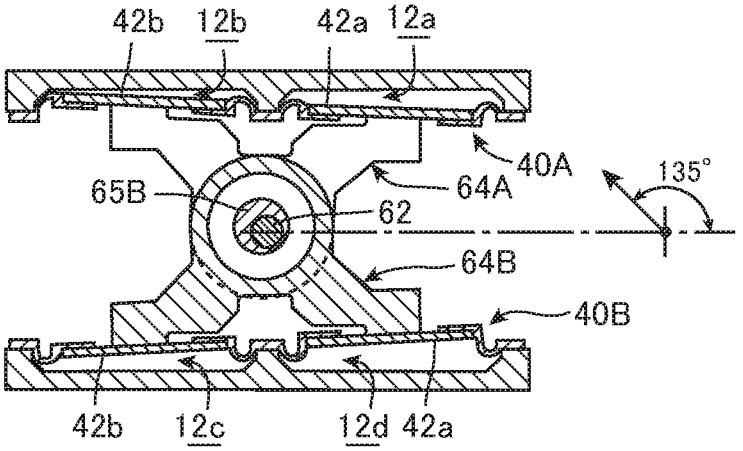
FIG. 7B illustrates a state in which a rotation shaft rotates by 90° from the state of FIG. 7A and the pump chamber at the upper left in the drawing is contracted.
Figure 7C:
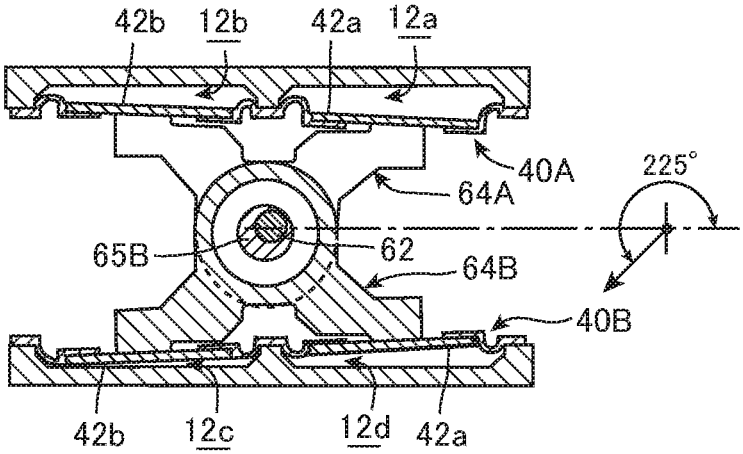
FIG. 7C illustrates a state in which the rotation shaft rotates by 90° from the state of FIG. 7B and the pump chamber at the lower left in the drawing is contracted.
Figure 7D:
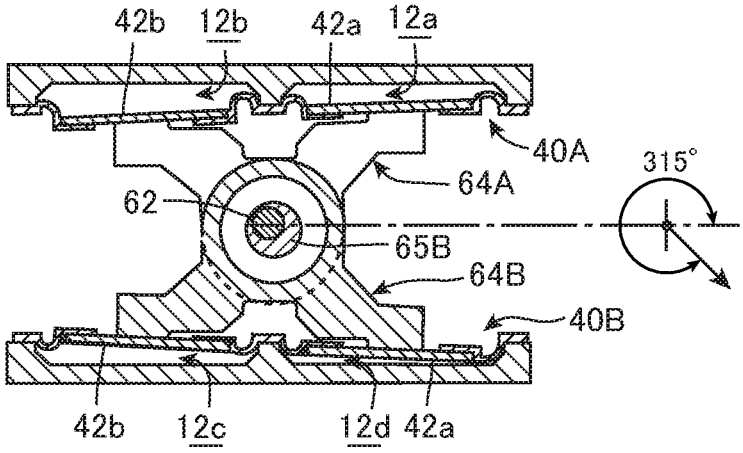
FIG. 7D illustrates a state in which the rotation shaft rotates by 90° from the state of FIG. 7C and the pump chamber at the lower right in the drawing is contracted.

Here, FIG. 7A illustrates a state in which the eccentric portions 65A and 65B are rotated counterclockwise by 45° with a state in which the portion having the largest eccentric amount in the eccentric portions 65A and 65B is horizontal toward the right side in the drawing as a reference (0°). In this state, the first pump chamber 12*a* is most contracted, and the third pump chamber 12*c* is most expanded. FIG. 7B illustrates a state where the rotation shaft 62 is rotated by 90° from the state of FIG. 7A. In this state, the second pump chamber 12*b* is most contracted, and the fourth pump chamber 12*d* is most expanded. FIG. 7C illustrates a state where the rotation shaft 62 is rotated by 90° from the state of FIG. 7B. In this state, the third pump chamber 12*c* is most contracted, and the first pump chamber 12*a* is most expanded. FIG. 7D illustrates a state where the rotation shaft 62 is rotated by 90° from the state of FIG. 7C. In this state, the fourth pump chamber 12*d* is most contracted, and the second pump chamber 12*b* is most expanded. Thereafter, when the rotation shaft 62 is rotated by 90° from the state of FIG. 7D, the state returns to the state of FIG. 7A, and thereafter, the states of FIGS. 7A to 7D are repeated.

Figure 8A:
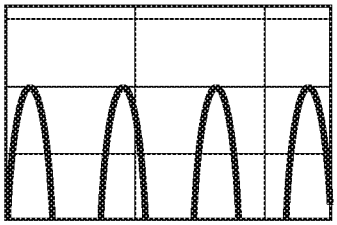
FIG. 8 is a diagram illustrating a relationship between the number of cylinders and the pulsating flow at the same flow rate.
Figure 8B:
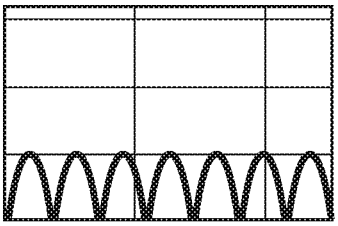
Figure 8C:
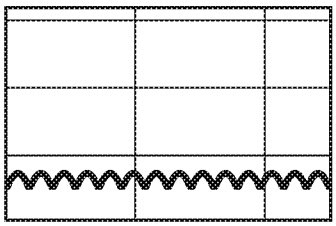

As described above, in the four-cylinder diaphragm pump 1 according to the first embodiment, since the four pump chambers 12*a* to 12*d* are expanded and contracted with the phase difference of 90°, it is possible to obtain a flow with less pulsation in which the four phases are synthesized (see FIG. 8C) in both intake air joined in the intake-side joining space 28*a* and exhaust air joined in the exhaust-side joining space 28*b* as compared with the case of the single phase (see FIG. 8A) or the two phases (see FIG. 8B). As a result, the four-cylinder diaphragm pump 1 according to the first embodiment has an advantage that the pulsating flow can be reduced and the flow rate can be stabilized, and an operation sound is reduced, as compared with the case of a single phase or two phases.

In particular, in the four-cylinder diaphragm pump 1 according to the first embodiment, as described above, the first diaphragm 40A includes the two diaphragm portions 42*a* and 42*b* on the same plane, and the second diaphragm 40B includes the two diaphragm portions 42*a* and 42*b* on the same plane which is arranged to be parallel to the plane of the first diaphragm 40A. According to such a configuration, it is possible to easily realize the four-phase four-cylinder having a phase difference of 90° in the configuration of the upper and lower two surfaces with a small number of components substantially similar to the two-phase two-cylinder pump. In addition, since the configuration has two upper and lower surfaces, the components such as the base member 20 can be basically formed in a shape that can be split up and down, and thus, can be adapted to mass production means such as plastic and die casting. Therefore, there are advantages that productivity is very high and assembling properties are good. Furthermore, since no movable component such as a rocker arm or a linear motion mechanism is required except for the pair of oscillating bodies (yokes), it is very excellent in terms of the number of components and reliability, and further, it is possible to dispose the diaphragm portions such that the distance between the diaphragm portions is extremely close to each other, and thus, downsizing can be achieved.

In addition, since the area of each of the diaphragm portions 42*a* and 42*b* can be reduced inversely proportionally by increasing the number of cylinders, the four-cylinder diaphragm pump 1 according to the first embodiment can be made smaller than a single-phase or two-phase pump.

Furthermore, in inertial collision type dust sampling or the like, it is required to have a constant flow rate, and thus it may be difficult to perform accurate sampling with a single-phase or two-phase pump. However, according to the four-cylinder diaphragm pump 1 according to the first embodiment, it is possible to obtain a flow with less pulsation, and thus, it is possible to use the four-cylinder diaphragm pump 1 for the purpose of requiring such a constant flow rate.

Although the preferred embodiments of the present invention have been described above, the technical scope of the present invention is not limited to the scope described in the above-described embodiments. Various modifications or improvements can be made to each of the above embodiments.

Second Embodiment

For example, in the first embodiment described above, the first diaphragm 40A and the second diaphragm 40B are disposed to face each other so as to be parallel to each other the rotation shaft 62 interposed therebetween, and the eccentric portion 65A of the first oscillating body 64A and the eccentric portion 65B of the second oscillating body 64B are eccentric to each other in the same direction, but the present invention is not limited thereto. For example, as in a second embodiment illustrated in FIG. 9, a first diaphragm 40A' and a second diaphragm 40B' may be disposed so as to be located on the same plane, and an eccentric portion 65A' of the first oscillating body 64A and an eccentric portion 65B' of the second oscillating body 64B may be eccentric in directions opposite to each other. In FIG. 9, only the configuration necessary for the description is illustrated, and for example, the configuration of the base member and the like is not illustrated.

Figure 9A:
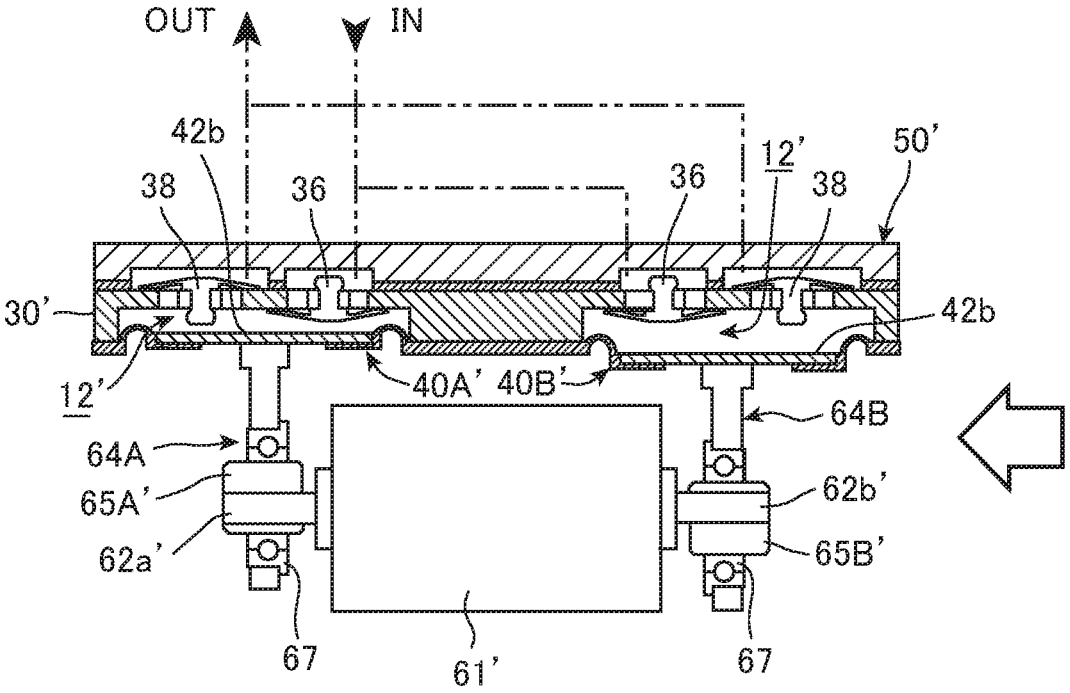
FIG. 9A is a diagram illustrating a partially omitted cross section along a direction parallel to a rotation shaft of a drive source.

In the four-cylinder diaphragm pump according to the second embodiment, as illustrated in FIG. 9A, a drive motor 61' is a double-shaft type motor having rotation shafts 62*a*' and 62*b*' at both ends, and the eccentric portion 65A' of the first oscillating body 64A is fixed to the rotation shaft 62*a*' on a left side in the drawing, and the eccentric portion 65B' of the second oscillating body 64B is fixed to the rotation shaft 62*b*' on a right side in the drawing. As described above, the eccentric portion 65A' of the first oscillating body 64A and the eccentric portion 65B' of the second oscillating body 64B are fixed in opposite directions so as to have a phase difference of 180 degrees from each other.

Figure 9B:
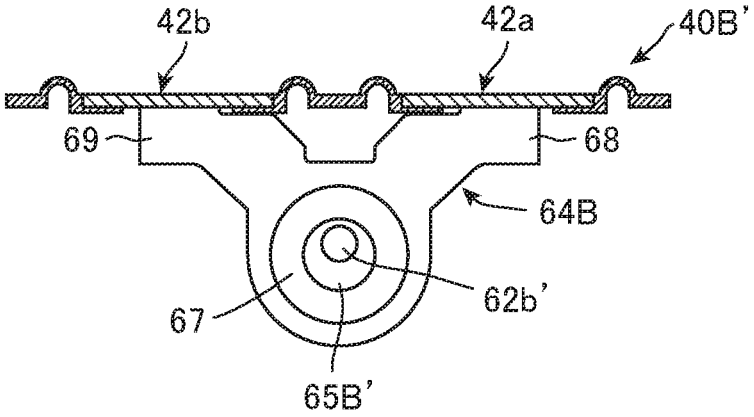
FIG. 9B is a diagram illustrating a partially omitted cross section along a direction orthogonal to the rotation shaft of the drive source.

In addition, as illustrated in FIG. 9B, the first diaphragm 40A' and the second diaphragm 40B' are disposed side by side in the depth direction in the drawing, and thus, a total of four diaphragm portions 42*a* and 42*b* are disposed in the same plane above the drive motor 61'. As illustrated in FIGS. 9A and 9B, in the first oscillating body 64A and the second oscillating body 64B, the first arm portion 68 and the second arm portion 69 are fixed to the pair of diaphragm portions 42*a* and 42*b*, respectively, and the attachment portion 66 is engaged with the eccentric portions 65A' and 65B' via the bearings 67, respectively.

Each of the diaphragm portions 42*a* and 42*b* is configured to form a pump chamber 12' together with the valve seat member 30'. An intake valve 36 and an exhaust valve 38 are attached to the valve seat member 30', and four pump elements are configured.

As described above, in the four-cylinder diaphragm pump according to the second embodiment, similarly to the four-cylinder diaphragm pump 1 according to the first embodiment, the pair of diaphragm portions 42*a* and 42*b* has a phase difference of 90° from each other, the first diaphragm 40A' and the second diaphragm 40B' have a phase difference of 180° as a whole, and thus, the four pump elements operate with a phase difference of 90°. Then, intake and exhaust in the four pump elements are synthesized by an intake-side joining space and an exhaust-side joining space (not illustrated) provided in the head member 50', respectively, and reach intake and exhaust ports (not illustrated), thereby obtaining a pump output with less pulsating flow.

Note that, in the four-cylinder diaphragm pump according to the second embodiment, FIG. 9 illustrates an example in which a double-shaft type motor is used as the drive motor 61' and the first diaphragm 40A' and the second diaphragm 40B' are disposed at both ends of the drive motor 61', but the present invention is not limited thereto. For example, it is also possible to have a configuration in which a rotation shaft of the drive motor is extended and the first diaphragm 40A' and the second diaphragm 40B' are disposed side by side in one direction as viewed from the drive motor.

Further, in the first and second embodiments described above, the pair of diaphragm portions 42*a* and 42*b* has been described as being integrally molded, but the present invention is not limited thereto, and separate diaphragms may be used individually. Further, in the second embodiment, the four diaphragm portions 42*a* and 42*b* can be integrated.

It is apparent from the description of the claims that the above modification examples are included in the scope of the present invention.

REFERENCE SIGNS LIST

1 four-cylinder diaphragm pump
10 pump body
12*a* to 12*d*, 12' pump chamber
40A, 40A' first diaphragm
40B, 40B' second diaphragm
42*a*, 42*b* diaphragm portion
45 centroid of diaphragm portion
60 drive mechanism
61, 61' drive motor (drive source)
62, 62*a*', 62*b*' rotation shaft
64A first oscillating body
64B second oscillating body
65A, 65A', 65B, 65B' eccentric portion
66 attachment portion
67 bearing
68 first arm portion
69 second arm portion
C center of bearing
P inter-centroid distance

The invention claimed is:

1. A four-cylinder diaphragm pump comprising: a pump body having four pump chambers; and a drive mechanism that expands and contracts the four pump chambers with a predetermined phase difference, the pump body including a first diaphragm having two diaphragm portions on a same plane, and a second diaphragm having two diaphragm portions on a same plane disposed parallel to the plane of the first diaphragm, each of the diaphragm portions of the first diaphragm and the second diaphragm constituting a portion of a different pump chamber of the four pump chambers, and the drive mechanism including a drive source having a rotation shaft extending parallel to each plane of the first diaphragm and the second diaphragm, a first oscillating body corresponding to the first diaphragm, and a second oscillating body corresponding to the second diaphragm, each of the two diaphragm portions of the first diaphragm and the second diaphragm separated from each other in a direction orthogonal to the rotation shaft with the rotation shaft as a boundary, each of the first oscillating body and the second oscillating body including an eccentric portion attached to the rotation shaft, an attachment portion attached to the eccentric portion via a bearing, a first arm portion extending from the attachment portion to one diaphragm portion of the two diaphragm portions, and a second arm portion extending from the attachment portion to an other diaphragm portion of the two diaphragm portions, the first diaphragm and the second diaphragm are disposed to face each other so as to be parallel to each other via the rotation shaft, and the eccentric portion of the first oscillating body and the eccentric portion of the second oscillating body are eccentric in the same direction.

2. The four-cylinder diaphragm pump according to claim 1, wherein a distance between the plane of the first diaphragm and a center of the bearing, in a direction orthogonal to the plane of the first diaphragm, is smaller than an inter-centroid distance between the two diaphragm portions of the first diaphragm, and a distance between the plane of the second diaphragm and a center of the bearing, in a direction orthogonal to the plane of the second diaphragm, is smaller than an inter-centroid distance between the two diaphragm portions of the second diaphragm.

* * * * *